US007401698B2

(12) United States Patent
Dost et al.

(10) Patent No.: US 7,401,698 B2
(45) Date of Patent: Jul. 22, 2008

(54) LATCH FOR TOOL ACCESSORY CASE

(75) Inventors: Hagen W. Dost, Chicago, IL (US); Creighton Wade Nachtigall, Chicago, IL (US)

(73) Assignee: Robert Bosch GmbH, Stuttgart (DE)

( * ) Notice: Subject to any disclaimer, the term of this patent is extended or adjusted under 35 U.S.C. 154(b) by 553 days.

(21) Appl. No.: 11/062,373

(22) Filed: Feb. 22, 2005

(65) Prior Publication Data

US 2006/0186003 A1 Aug. 24, 2006

(51) Int. Cl.
*A45C 11/26* (2006.01)

(52) U.S. Cl. ..... 206/349; 206/372; 220/324; 220/326

(58) Field of Classification Search ..... 206/349, 206/372, 373, 374, 375, 379; 220/324, 326
See application file for complete search history.

(56) References Cited

U.S. PATENT DOCUMENTS

| | | | | | |
|---|---|---|---|---|---|
| 2,893,771 | A * | 7/1959 | Claud-Mantle | ..... | 292/113 |
| 3,466,076 | A * | 9/1969 | Bisbing | ..... | 292/109 |
| 3,730,576 | A * | 5/1973 | Schurman | ..... | 292/246 |
| 5,125,697 | A * | 6/1992 | Kahl et al. | ..... | 292/204 |
| 5,193,706 | A * | 3/1993 | Hanna et al. | ..... | 220/324 |
| 5,735,428 | A * | 4/1998 | Chern | ..... | 220/324 |
| 5,738,238 | A * | 4/1998 | Yang | ..... | 220/324 |
| 5,887,715 | A | 3/1999 | Vasudeva | | |
| 5,915,553 | A * | 6/1999 | Brown et al. | ..... | 206/372 |
| 6,105,767 | A | 8/2000 | Vasudeva | | |
| 6,213,296 | B1 | 4/2001 | Streich et al. | | |
| 6,405,864 | B1 | 6/2002 | Streich et al. | | |
| 6,698,609 | B2 | 3/2004 | Pangerc et al. | | |
| 6,755,302 | B1 | 6/2004 | Streich et al. | | |
| 6,789,692 | B2 * | 9/2004 | Prezelin | ..... | 220/324 |
| 7,165,674 | B2 * | 1/2007 | Pangerc et al. | ..... | 206/379 |
| 2004/0099554 | A1 | 5/2004 | Pangerc et al. | | |
| 2004/0144671 | A1 | 7/2004 | Hallee et al. | | |
| 2004/0154942 | A1 | 8/2004 | Streich et al. | | |
| 2004/0178202 | A1 * | 9/2004 | Serio | ..... | 220/324 |
| 2006/0042897 | A1 * | 3/2006 | Sanderson | ..... | 190/120 |

* cited by examiner

*Primary Examiner*—David T Fidei
(74) *Attorney, Agent, or Firm*—Greer, Burns & Crain, Ltd.

(57) ABSTRACT

A preferred embodiment of the present invention is directed to a tool accessory case having first and second housing members pivotally connected to each other along a hinge portion and forming a tool holding cavity. A latch is connected to the first housing member and is moveable between latched and unlatched positions. The latch has a gripping structure configured for gripping the second housing member, and at least one flexure member configured to contact the first housing member and bias the latch toward the latched position. The latch also has at least one fixed hinge guide for pivoting with respect to the first housing member and with respect to the flexure member. The tool accessory case also has a receiving structure disposed on the second housing member and is configured to receive the gripping structure of the latch when the latch is in the latched position.

17 Claims, 5 Drawing Sheets

LATCH FOR TOOL ACCESSORY CASE

FIELD OF THE INVENTION

The present invention is related to tool accessory cases. More particularly, the present invention is related to a latching mechanism used in a tool accessory case.

BACKGROUND OF THE INVENTION

Accessory cases are commonly used by consumers and individuals in many professions to organize small parts such as drill bits, fasteners, and nails. Frequently, accessories of this sort are available in sets of varying size and shape and are used for different purposes. It is desirable to keep the accessories organized so that the user can easily locate the specific tool accessory for the particular purpose.

Tool accessories are commonly organized in individual compartments that are stored within the tool accessory case, and the case is secured with a latch to prevent the tool accessories from escaping the compartment. While a tool accessory case has the advantage of confining the tool accessory to the inner organizational compartment, the latch on the case may be difficult to open and close, particularly if the user is wearing work gloves or only has one hand available. Further, some latches are prone to open upon impact, such as when the case is dropped, allowing the tool accessories to escape the tool accessory case.

SUMMARY OF THE INVENTION

A preferred embodiment of the present invention is directed to a tool accessory case having first and second housing members pivotally connected to each other along a hinge portion and forming a tool holding cavity. A latch is connected to the first housing member and is moveable between latched and unlatched positions. The latch has a gripping structure configured for gripping the second housing member, and at least one flexure member configured to contact the first housing member and bias the latch toward the latched position. The latch also has at least one fixed hinge guide for pivoting with respect to the first housing member and with respect to the flexure member. The tool accessory case also has a receiving structure disposed on the second housing member and is configured to receive the gripping structure of the latch when the latch is in the latched position.

In another embodiment, a latch has at least one flexure member on a first portion of the latch and a gripping structure on a second portion of the latch. The latch also has at least one fixed hinge guide configured for pivoting with respect to a first housing member and with respect to the flexure member. The fixed hinge guide and the flexure member are integrally formed on the latch.

Alternatively, a latch is connected to a first housing member and has a flexure member extending from an outer surface of a fixed hinge guide. The flexure member is configured to contact the first housing member and bias the latch toward a latched position.

DETAILED DESCRIPTION

Figure 1:
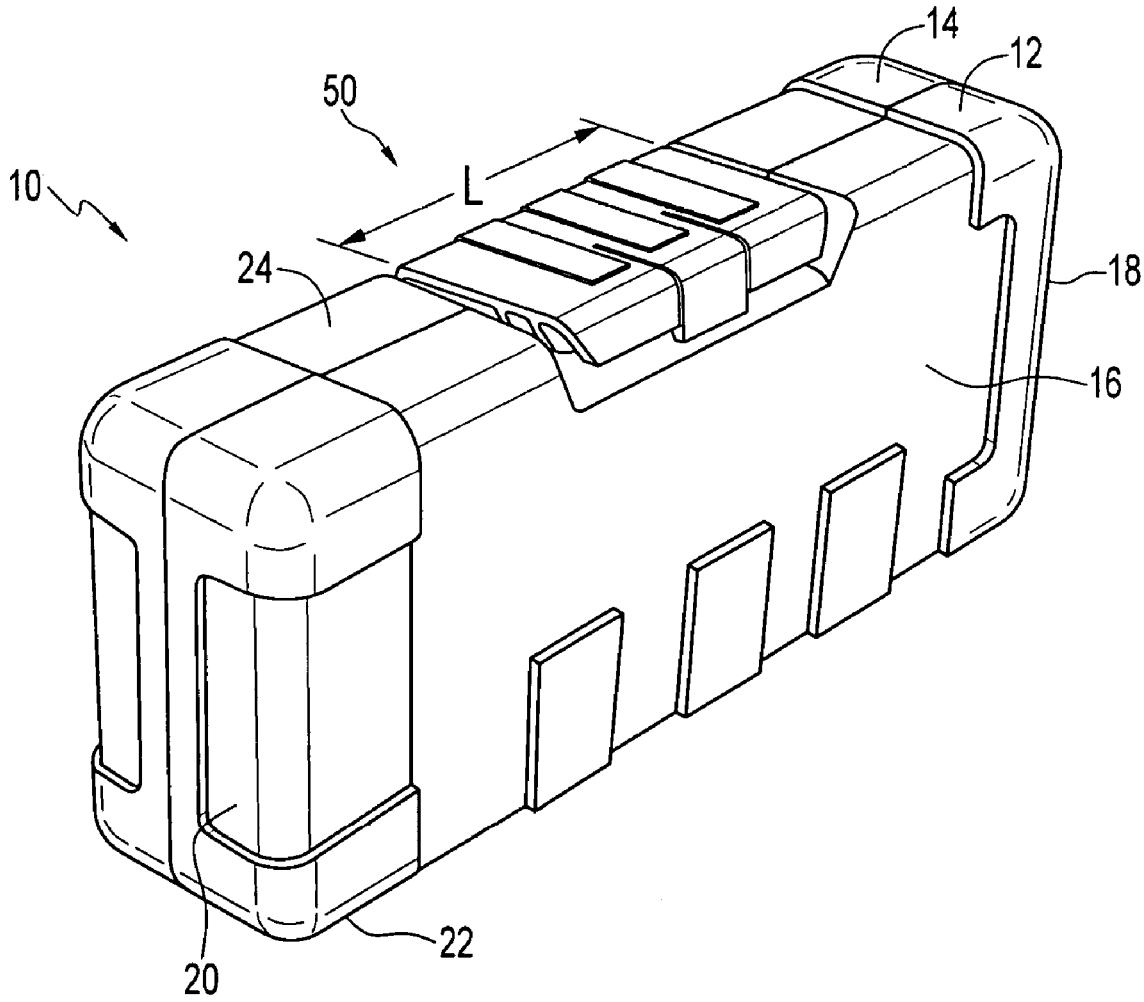
FIG. 1 is a perspective view of a preferred embodiment of a tool accessory case in a latched position and having a latch in a non-deflected state.
Figure 2:
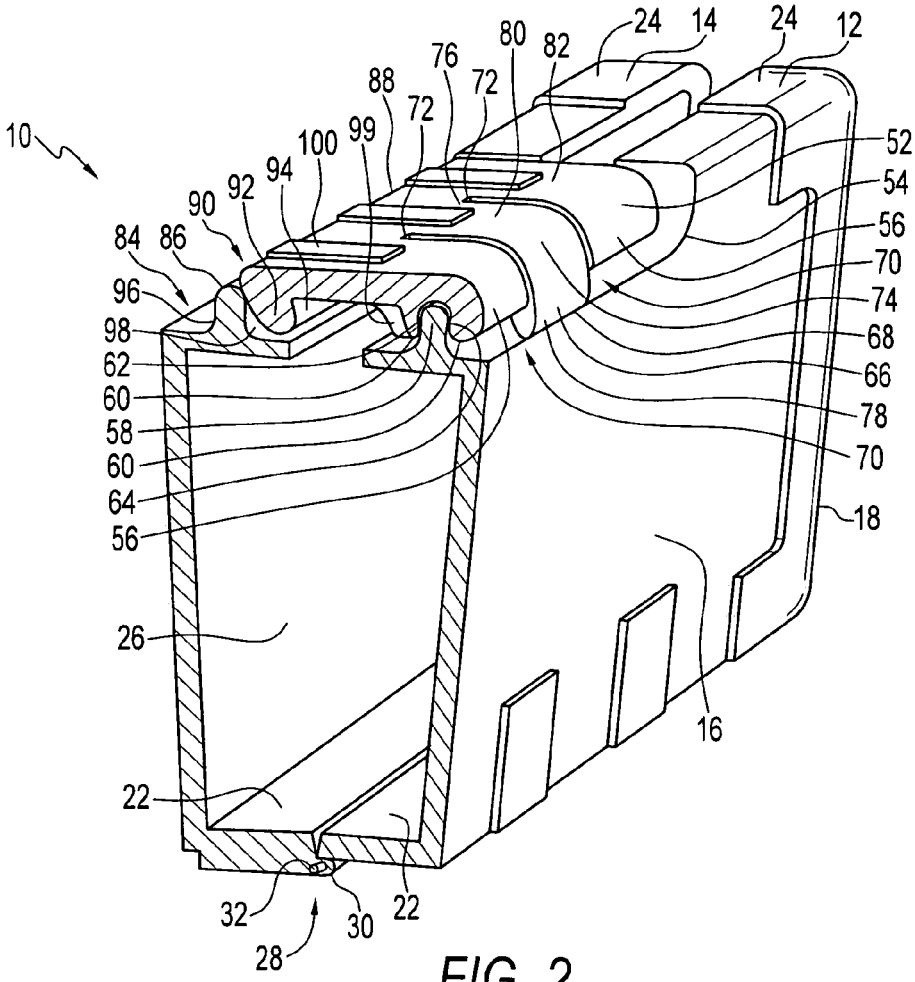
FIG. 2 is a cross-section view of the latch and the tool accessory case of FIG. 1 with the tool accessory case in an unlatched position and the latch in a non-deflected state.

Turning now to the drawings, and particularly to FIGS. 1 and 2, a tool accessory case indicated generally at 10 is shown to have a generally rectangular housing having first and second housing members 12, 14 in which tool accessories can be stored. Each housing member 12, 14 preferably includes a base 16 with two short sides 18, 20, a hinged side 22 and a top side 24 defining a tool holding cavity 26 therein, as is known in the art. Preferably, the tool case 10 is made of molded plastic, but other materials may be used, provided that the materials have the requisite flexibility.

Referring now to FIG. 2, the hinged side 22 of the housing members 12, 14 are pivotally connected to each other along a hinge 28, which permits the housing members to open and close with respect to each other. The hinge 28 preferably includes an integrally formed sleeve 30 and a rod 32 disposed therein; however, other hinges are contemplated.

Figure 3:
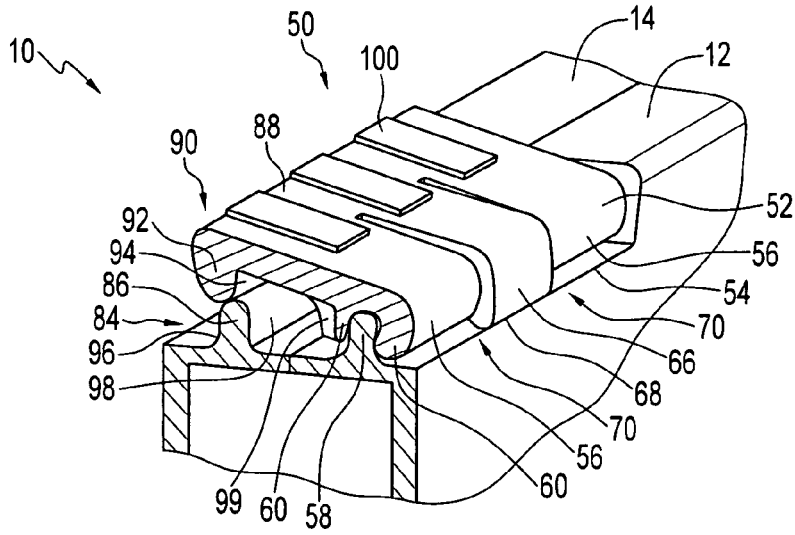
FIG. 3 is a cross-section view of the latch and the tool accessory case of FIG. 1 with the tool accessory case in an unlatched position and the latch in a deflected state.

FIG. 3 shows the case 10 in an unlatched position, and a latch 50 is connected at a first portion 52 of the latch to the first housing member 12 at a recess portion 54 of the housing member. The latch 50 is preferably made of a durable molded plastic, although other materials exhibiting resilient material properties may be used.

The latch 50 has at least one and preferably two fixed hinge guides 56 pivotally disposed over a raised rib 58 of the first housing member 12. Each fixed hinge guide 56 preferably has two prongs 60 which are configured to sit at an inside surface 62 and an outside surface 64 of the raised rib. In this configuration, the fixed hinge guide 56 maintains the latch 50 in pivotal communication with the raised rib 58, and maintains the latch on the first housing member 12. Alternatively, the latch 50 can be disposed on the second housing member 14. The fixed hinge guide 56 is configured not to flex or deform.

A flexure member 66 is preferably disposed between the fixed hinge guides 56 and is configured to contact the first housing member 12 at a recess contact surface 68. The flexure member 66 is preferably integrally formed of molded plastic with the fixed hinge guides 56 to form the latch 50, but it is contemplated that different materials may be used for the flexure member. In particular, it is contemplated that the flexure member 66 can be replaced with other resilient materials. The flexure member 66 is configured to bias the latch 50 generally parallel to the top side 24.

A vent, indicated generally at 70, is located between the flexure member 66 and each fixed hinge guide 56. The vent 70 is preferably a thin slot 72 which permits the fixed hinge guides 56 to displace and pivot with respect to the flexure member 66, and the flexure member to deflect with respect to the fixed hinge guides. The vents 70 preferably extend approximately half the width of the latch 50 and, in the preferred embodiment, the vents divide the flexure member 66 and the fixed hinge guides 56 into three approximately equal segments along the length "L" of the latch (FIG. 1).

In the preferred embodiment, the vents 70 define a flexible arm 74, although other flexible members are contemplated. Further, the flexible arm 74 has a proximal end 76 disposed generally centrally on the latch 50, and a distal end 78 which is configured to contact the recess contact surface 68. The flexible arm 74 has an outer surface 80 that is coextensive with the outer surface 82 of the first portion 52 of the latch 50. The distal end 78 of the flexible arm 74 is separated from adjacent portions of the first portion 52 of the latch 50 so that the distal end can flex and deflect relative to the adjacent fixed hinge guides 56.

The second housing member 14 has a receiving structure 84, preferably a catch 86 disposed on the recess portion 54 and protruding generally perpendicularly from the second housing member. Preferably, the catch 86 is integral with the second housing member 14 and has a similar structure to the raised rib 58. Opposite the fixed hinge guide 56 at a second portion 88 and protruding generally perpendicularly from the latch 50 is a gripping structure 90 configured to engage the receiving structure 84. Preferably, the gripping structure 90 is a jut 92 having a size and shape that permits an inside surface 94 of the jut to engage an outside surface 96 of the catch 86.

As can be seen in FIGS. 2 and 3, when the first and second housing members 12, 14 are moved towards each other, the jut 92 hits the catch 86 (FIG. 2) and the fixed hinge guides 56 pivot about the raised rib 58 allowing the jut to displace and generally traverse the inside surface 98 of the catch 86 (FIG. 3). Meanwhile, the flexure member 66 is compressed against the recess portion 54 on the first housing member 12 and slightly deflects with respect to the fixed hinge guides 56. The resiliency of the material permits the flexure member 66 to deflect, which permits the fixed hinge guides 56 to rotate and the gripping structure 90 to displace up over the catch 96, while biasing the latch 50 to a latched, non-deflected position (See FIGS. 2 and 4 for the latch in a biased, non-deflected position).

Figure 4:
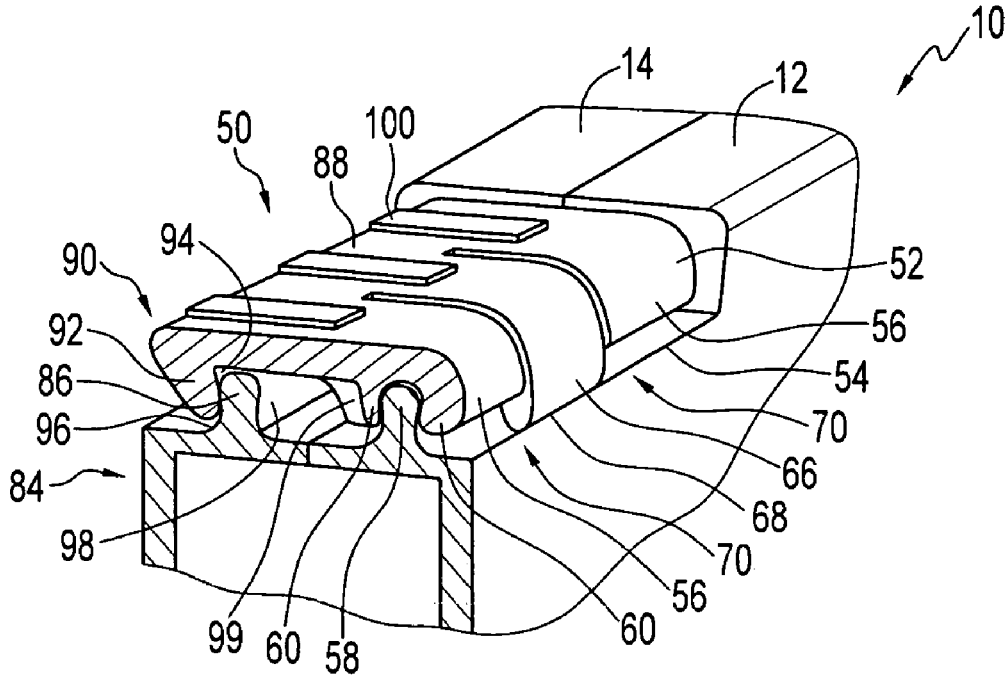
FIG. 4 is a cross-section view of the latch and the tool accessory case of FIG. 1 with the tool accessory case in a latched position and the latch in a non-deflected state.

Referring now to FIGS. 3 and 4, when the jut 92 has reached the top of the catch 86, and while the user is still moving the first and second housing members 12, 14 towards each other into a latched position, the jut generally traverses the outside surface 96 of the catch 86 and the gripping structure 90 will latch with the receiving structure 84. Since the flexure member 66 is compressed against the recess portion 54 of the housing member 12 when the jut 92 traverses the catch 86, the flexure member biases the jut into engagement on the outside surface 96 of the catch 86 so that the flexure member can return to a non-deflected state. In this configuration, only one hand of the user is required to close the case 10 since the latch 50 is biased toward a latched position. Further, when the case 10 is closed and the latch 50 is in a latched position, the latch tends to remain in a latched position because the flexure member 66 biases the latch closed, thus limiting accidental opening of the case upon drop impact. To unlatch the latch 50, a user overcomes the bias of the flexure member 66, thereby compressing the flexure member against the recess contact surface 68, deflecting the flexure member, and the user moves the jut 92 over the outside surface 96 of the catch 86.

Since the latch 50 is subject to areas of localized stress near the fixed hinge guide 56, the latch preferably has at least one lower support rib 99 at each prong 60. Further, upper support ribs 100 are preferably disposed on each of the fixed hinge guides 56 and the flexure member 66 to further strengthen the structure of the latch 50. It is also contemplated that additional support structure can be disposed anywhere on the latch 50.

Figure 5:
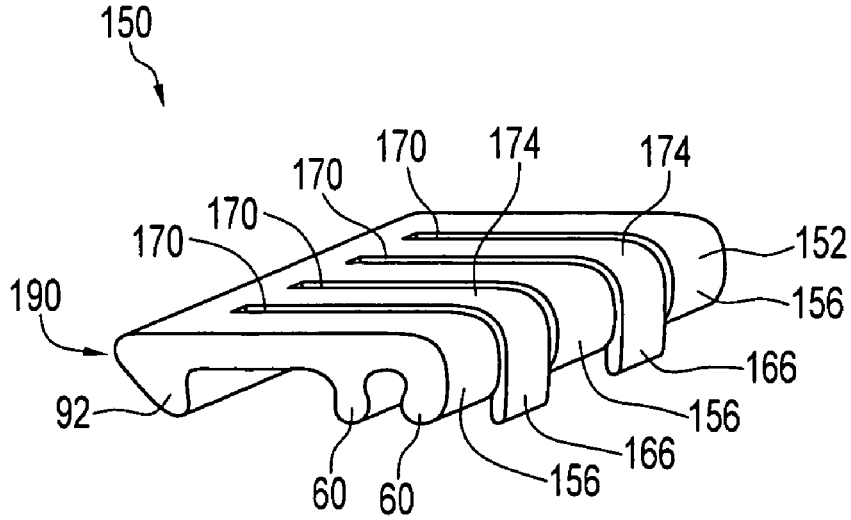
FIG. 5 is a perspective view of a second embodiment of the latch for the tool accessory case of FIG. 1.

Referring now to FIG. 5, a second embodiment of the latch 50 for the tool accessory case 10 is generally designated 150 and has a plurality of flexure members 166. Shared components with the first embodiment of the latch 50 are designated with identical reference numbers and similar components with the first embodiment are designated with corresponding reference numbers in the 100-series. The second embodiment 150 generally functions similarly to the first embodiment 50.

With reference to FIGS. 2 and 5, the preferably integrally formed latch 150 preferably has three fixed hinge guides 156 on a first portion 152 of the latch. The fixed hinge guides 156 are configured to be pivotally arranged over a raised rib 58 of the first housing member 12. Similar to the first embodiment of the latch 50, the fixed hinge guides 156 maintain the latch 150 in pivotal communication with the raised rib 58, and maintains the latch 150 on the first housing member 12.

Preferably disposed between the fixed hinge guides 156 are the flexure members 166 configured to contact the first housing member 12 at the recess portion 54. The flexure members 166 are preferably integrally formed with the fixed hinge guides 156, and form flexible arms 174 configured to bias the latch 150 generally parallel to the top side 24 of the housing members 12, 14. Vents 170 are preferably disposed between each flexible arm 174 and fixed hinge guide 156.

Like the latch 50, the flexure members 166 deform to permit the fixed hinge guides 156 to rotate and to displace, which in turn permits the gripping structure 190 disposed on a second portion 188 of the latch to engage on the receiving structure 84. In this configuration, the latch 150 is biased in a latched position and the flexure members 166 temporarily flex or deflect to permit latch engagement. Although the flexure members 66 and 166 of the latches 50, 150 have been disposed generally centrally, it is contemplated that the flexure members can be arranged on the ends of the latch.

Figure 6:
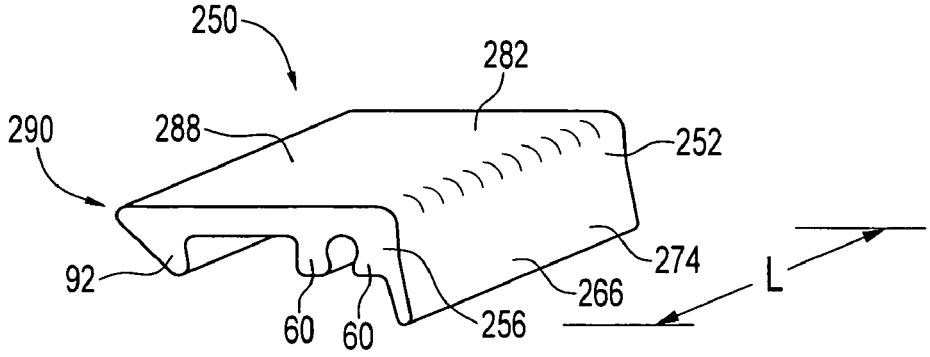
FIG. 6 is a perspective view of a third embodiment of the latch for the tool accessory case of FIG. 1.
Figure 7:
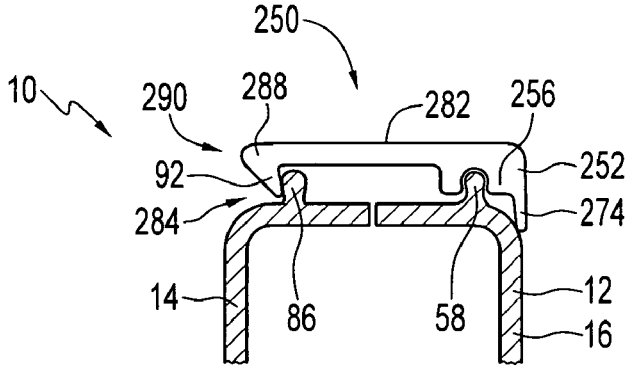
FIG. 7 is a cross-section of the tool accessory case of FIG. 1 in a latched position and the latch embodiment of FIG. 6 in a non-deflected state.
Figure 8:
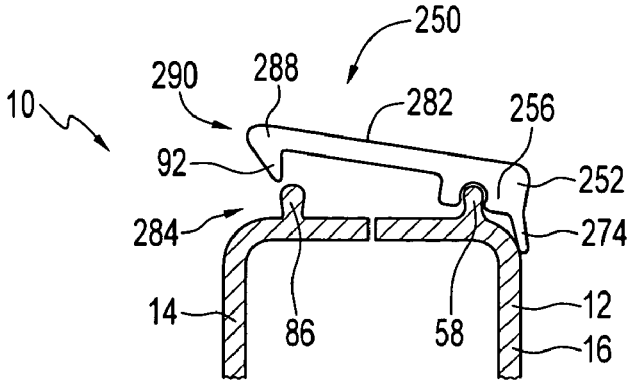
FIG. 8 is a cross-section of the tool accessory case of FIG. 1 in an unlatched position and the latch embodiment of FIG. 6 in a deflected state.

A third embodiment of the latch 50 for the tool accessory case 10 is generally designated 250 and is shown in FIGS. 6-8. Shared components with the first embodiment of the latch 50 are designated with identical reference numbers and similar components with the first embodiment are designated with corresponding reference numbers in the 200-series. The third embodiment 250 generally functions the same way as the first and second embodiments 50, 150.

The latch 250 of the third embodiment has a flexure member 266 on a first portion 252 and a gripping structure 290 on a second portion 288. The flexure member 266 is preferably an integrally formed flexible arm 274 which preferably substantially extends the length "L" of the latch 250. The flexible arm 274 preferably extends from the fixed hinge guide 256 and is generally perpendicular to the top surface 282 of the latch and generally parallel with the base 16.

The flexible arm 274 is configured to bias the latch 250 into a latched position. Similar to the previous embodiments, the flexible arm 274 is deformed as it is compressed against the housing member 12, and the gripping structure 290 is displaced up and over the receiving structure 284 to engage the gripping structure onto the receiving structure. FIG. 7 shows the flexible arm 274 in the latched, non-deflected position, and FIG. 8 shows the flexible arm in the unlatched, deflected position.

Figure 9:
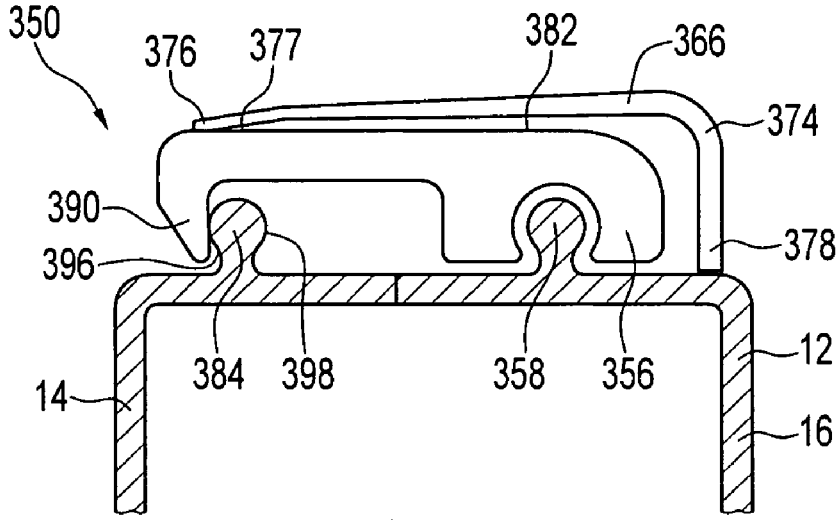
FIG. 9 is a cross-section of the tool accessory case of FIG. 1 and a fourth embodiment of the latch of FIG. 1 in a latched, non-deflected position.
Figure 10:
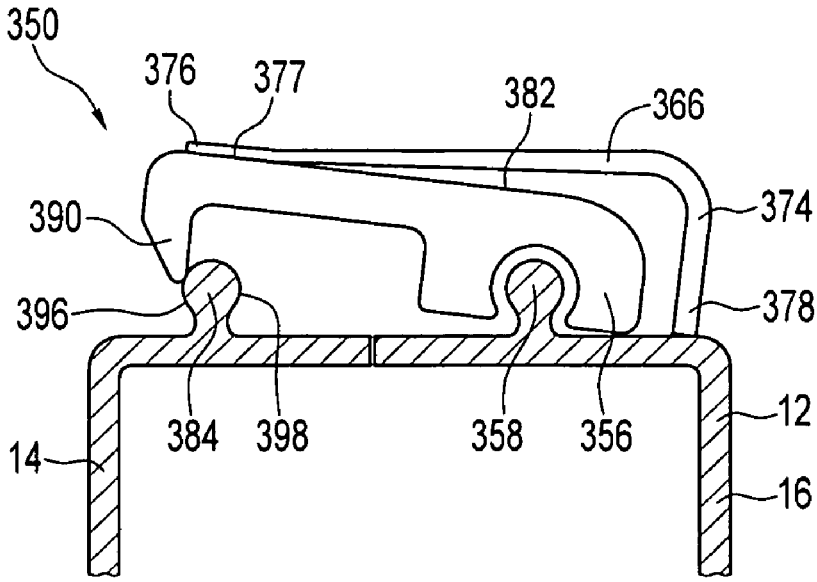
FIG. 10 is a cross-section of the tool accessory case of FIG. 1 and the latch of FIG. 9 in an unlatched, deflected position.

Referring now to FIGS. 9 and 10, a fourth embodiment of the latch of a tool accessory case 10 is generally designated 350 and is shown in both a latched, non-deflected position and an unlatched, deflected position. Shared components with the first embodiment of the latch 50 are designated with identical reference numbers and similar components with the first embodiment are designated with corresponding reference numbers in the 300-series. The fourth embodiment 350 generally functions similar to the first, second and third embodiments 50, 150 and 250 in that the latch has a flexure member 366 that is configured to contact one of the housing members 12, 14 and bias the latch toward the latched position.

In the latch 350, a flexure member 366 is preferably at least one generally "L"-shaped flexible arm 374 that extends over the outer surface 382 of at least one fixed hinge guide 356. The flexible arm 374 contacts the housing member 12 with a distal end 378, and also contacts the fixed hinge guide 356 with a proximal end 376. Preferably made of a resilient material, the flexible arm 374 can be integrally formed with the fixed hinge guide 356, or can be a separate member attached to the fixed hinge guide at an attachment portion 377. Further, it is contemplated that the contacts of the flexible arm 374 with the fixed hinge guide 356 and with the housing member 12 can also be a sliding engagement, a fixed engagement or any other engagement, as long as the flexible arm 374 biases the latch 350 toward the latched position.

The flexible arm 374 is configured to flex as the fixed hinge guide 356 is pivoted about a raised rib 358. When the housing members 12, 14 are moved towards each other, a gripping structure 390 is configured to contact an inside surface 398 of the receiving structure 384 and the flexible arm 374 is configured to temporarily flex and deflect, as shown in FIG. 10. Further, the resiliency of the flexible arm 374 biases latch 350 to position the gripping structure 390 to engage on an outside surface 396 of the receiving structure 384.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the following claims.

What is claimed is:

1. A tool case comprising:

first and second housing members pivotally connected to each other along a hinge portion, said housing members forming a tool holding cavity;

a latch connected to said first housing member and being moveable between latched and unlatched positions, said latch having a gripping structure configured for gripping said second housing member, at least one flexure member configured to contact said first housing member and bias said latch toward said latched position, and at least one fixed hinge guide configured for pivoting with respect to said first housing member and with respect to said flexure member; and a receiving structure disposed on said second housing member and configured to receive said gripping structure of said latch when said latch is in said latched position;

wherein said flexure member comprises at least one flexible arm configured to contact said first housing member and to deflect when said latch is pivoted toward said open position, and to provide a biasing force toward said non-deflected, latched position.

2. A tool case as defined in claim 1 wherein said flexure member comprises a resilient material.

3. A tool case as defined in claim 1 further comprising at least one support rib.

4. A tool case as defined in claim 1 wherein said receiving structure is a catch and said gripping structure is a jut.

5. A tool case as defined in claim 1 wherein said at least one fixed hinge guide and said at least one flexure member are integrally formed.

6. A tool case comprising:

first and second housing members pivotally connected to each other along a hinge portion, said housing members forming a tool holding cavity;

a latch pivotally connected to said first housing member and being moveable between latched and unlatched positions, said latch having a gripping structure on a second portion of said latch configured for gripping said second housing member, at least one flexure member disposed on a first portion of said latch, said flexure member being configured to contact said first housing member and bias said latch toward said latched position, and at least one fixed hinge guide configured for pivoting with respect to said first housing member and with respect to said flexure member, wherein said fixed hinge guide and said flexure member are integrally formed on said latch; and a receiving structure disposed on said second housing member and configured to receive said gripping structure of said latch when said latch structure is in said latched position;

wherein said flexure member comprises at least one flexible arm configured to contact said first housing member and to deflect when said latch is pivoted toward said open position, and to provide a biasing force toward said non-deflected, latched position.

7. A tool case as defined in claim 6 wherein said flexible arm has an outer, top surface that is generally planar with the outer, top surface of said fixed hinge guide, said flexible arm having a distal end that is separated from said fixed hinge guide so that said distal end can flex relative to said fixed hinge guide.

8. A tool case as defined in claim 6 wherein said first end has at least one hinge portion.

9. A tool case as defined in claim 6 wherein said at least one flexible arm comprises two arms.

10. A tool case as defined in claim 9 wherein said two arms are spaced between said fixed hinge guides.

11. A tool case as defined in claim 9 wherein said receiving structure is a catch and said gripping structure is a jut.

12. A tool case as defined in claim 6 wherein said flexible arm extends from said fixed hinge guide substantially along the length of said latch and is generally perpendicular to a top surface of said fixed hinge guide.

13. A tool case comprising:

first and second housing members pivotally connected to each other along a hinge portion, said housing members forming a tool holding cavity;

a latch connected to said first housing member and being moveable between latched and unlatched positions, said latch having a gripping structure configured for gripping said second housing member, at least one fixed hinge guide configured for pivoting with respect to said first housing member, and at least one flexure member extending from an outer surface of said fixed hinge guide and configured to contact said first housing member and bias said latch toward said latched position; and a receiving structure disposed on said second housing member and configured to receive said gripping structure of said latch when said latch is in said latched position;

wherein said flexure member comprises at least one flexible arm configured to contact said first housing member and to deflect when said latch is pivoted to said unlatched position, and to provide a biasing force toward said non-deflected, latched position.

14. A tool case as defined in claim 13 wherein said flexure member temporarily flexes to permit said gripping structure to engage with said receiving structure.

15. A tool case as defined in claim 13 wherein said flexure member is integrally formed with said fixed hinge guide.

16. A tool case as defined in claim 13 wherein said flexure member is attached to said fixed hinge guide.

17. A tool case as defined in claim 13 wherein said fixed hinge guide is configured for pivoting with respect to said first housing member and with respect to said flexure member.

* * * * *